United States Patent [19]

Jeschke

[11] 4,453,467

[45] Jun. 12, 1984

[54] INK METERING DEVICE IN AN INK DUCT FOR OFFSET OR LETTERPRESS PRINTING MACHINES

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 264,138

[22] Filed: May 15, 1981

[30] Foreign Application Priority Data

May 16, 1980 [DE] Fed. Rep. of Germany ..... 3018784

[51] Int. Cl.[3] ..... B41F 1/46

[52] U.S. Cl. ..... 101/363

[58] Field of Search ..... 101/363, 364, 365

[56] References Cited

U.S. PATENT DOCUMENTS

| | | | |
|---|---|---|---|
| 2,062,154 | 11/1936 | Welk | 101/365 |
| 2,161,943 | 6/1939 | Baue | 101/365 |
| 3,855,927 | 12/1974 | Simeth | 101/157 |
| 4,089,264 | 5/1978 | Jeschke et al. | 101/109 |
| 4,242,958 | 1/1981 | Jeschke | 101/365 |
| 4,328,748 | 5/1982 | Schramm | 101/365 |

*Primary Examiner*—Robert A. Hafer
*Assistant Examiner*—Bradley M. Lewis
*Attorney, Agent, or Firm*—Herbert L. Lerner; Laurence A. Greenberg

[57] ABSTRACT

Ink metering device in an ink duct for offset or letterpress printing machines having an ink duct roller with metering and support regions disposed adjacent one another in axial direction of the ink duct roller, the metering regions being formed of metering elements adjustable zonewise to varying ink gap spacings, and the support regions continuously contacting the ink duct roller at least indirectly, under spring biasing force, including a flexionally elastic support rail extending over the entire length of the ink duct roller, the support regions being rigid support ledges formed on the support strip, the metering elements being disposed between the support ledges, and adjusting means operatively associated with the metering elements for zonally varying the ink gap spacings for the respective metering elements.

3 Claims, 5 Drawing Figures

INK METERING DEVICE IN AN INK DUCT FOR OFFSET OR LETTERPRESS PRINTING MACHINES

The invention relates to an ink metering device in an ink duct for offset or letterpress printing machines with metering and support regions disposed adjacent one another in axial direction of an ink duct roller, the metering regions being formed of metering elements adjustable for zonally varying ink gap spacings, and the support regions continuously contacting the ink duct roller directly or indirectly under spring pressure.

An ink duct of the foregoing general type has become known from German Published Prosecuted application (DAS) No. 26 48 098 wherein support and metering regions are disposed adjacent one another in axial direction of the ink duct roller on the individual zonewide adjusting elements. Due to the springy or resilient support or bracing of each individual adjusting element operatively against the ink duct roller, an always reproducible adjustment of the ink film thickness is realized through the metering regions. Furthermore, deviations in the ink film thickness, such as are caused by out-of-round rotation of the ink duct roller, for example, are avoided. Adjustment of mutually adjacent zones has no effect upon one another. The aforementioned reproducibility of the ink film is unalterable especially for the remote control of ink zones used in modern printing machine constructions.

Because the adjusting elements must be provided with supporting and metering surfaces, which requires a very painstaking machining or processing thereof and, also, considering the use of very numerous components, a very high manufacturing expense must be expected. Since all of the parts of the ink metering device must, furthermore, be individually assembled on the ink duct, a marked expense for assembly of the ink metering device, moreover, results.

It is accordingly an object of the invention to provide, while maintaining the very considerable advantages of a device such as that disclosed in the aforementioned German Published Prosecuted Application (DAS) No. 26 48 098 with respect to reproducibility and the possibility of zonewise adjustment of the ink film, an ink metering device in an ink duct for offset and letterpress printing machines which, due to the structural appearance thereof, forms a compact structural unit, the expense of manufacture thereof being reduced and assembly thereof being facilitated.

With the foregoing and other objects in view, there is provided, in accordance with the invention, an ink metering device in an ink duct for offset or letterpress printing machines having an ink duct roller with metering and support regions disposed adjacent one another in axial direction of the ink duct roller, the metering regions being formed of metering elements adjustable zonewise to varying ink gap spacings, and the support regions continuously contacting the ink duct roller at least indirectly, under spring biasing force, comprising a flexionally elastic support rail extending over the entire length of the ink duct roller, the support regions being rigid support ledges formed on the support strip, the metering elements being disposed between the support ledges, and adjusting means operatively associated with the metering elements for zonally varying the ink gap spacings for the respective metering elements.

The advantages derived from the invention are, in essence, that the ink metering device with the metering elements in the continuous support strip together with the adjusting means can be placed upon the ink duct as a completely assembled structural unit. Furthermore, in case it should be considered to be necessary, the possibility is afforded by the invention of effecting adjustment and zero point setting, respectively, of all of the metering elements, for example on a suitable test stand or similar device, even before the installation thereof into the ink duct. Furthermore, the ink-free region which develops on the ink duct roller is very confined because, among the parts of the inventive device associated with each of the metering elements, only a single narrow support ledge is required, which facilitates distribution of ink on the ink-free stripes.

By selecting and combining, respectively, the stiffness of the elastic region of the support strip and the hardness of the springs, which provide for the continuous operative contacting of the support strip, via the support ledges, with the ink duct roller, the efficiency of the device according to the invention is established.

To prevent soiling of the ink metering device, there is provided, in accordance with a further feature of the invention, an elastic foil covering the support strip and the metering elements and through which the support regions continuously contact the ink duct roller operatively. The foil can be deformed in the metering regions to permit passage of the desired quantity of ink.

In accordance with an added feature of the invention, the metering elements are formed as flat tongues, are disposed between the support ledges of the elastic support strip and are displaceable tangentially to the ink duct roller; holding screws for connecting the metering elements and the support strip to one another so as to permit relative movement thereof only in longitudinal direction; the adjusting means comprising adjusting screws engaging in threaded bores formed in an upper region of the elastic support strip; and a plurality of small pins extending from the support strip in the upper region thereof from which the elastic foil is suspended for protecting the ink metering device.

In accordance with an alternate feature of the invention, the metering elements are disposed between the support ledges of the elastic support strip and releasably fastened to the support strip; the adjusting means comprising respective springs and electromagnets disposed on the elastic support strip and operatively associated with the metering elements for continuously bringing the metering elements pulsatingly into operative contact with the ink duct roller and forming a predetermined gap therebetween; the adjusting means being actuatable for adjusting the frequency of the pulsations and the stroke time thereof, and means in an upper region of the metering elements for fastening the elastic foil to the metering elements so as to protect the ink metering device.

Other features which are considered as characteristic for the invention are set forth in the appended claims.

Although the invention is illustrated and described herein as embodied in an ink metering device in an ink duct for offset or letterpress printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
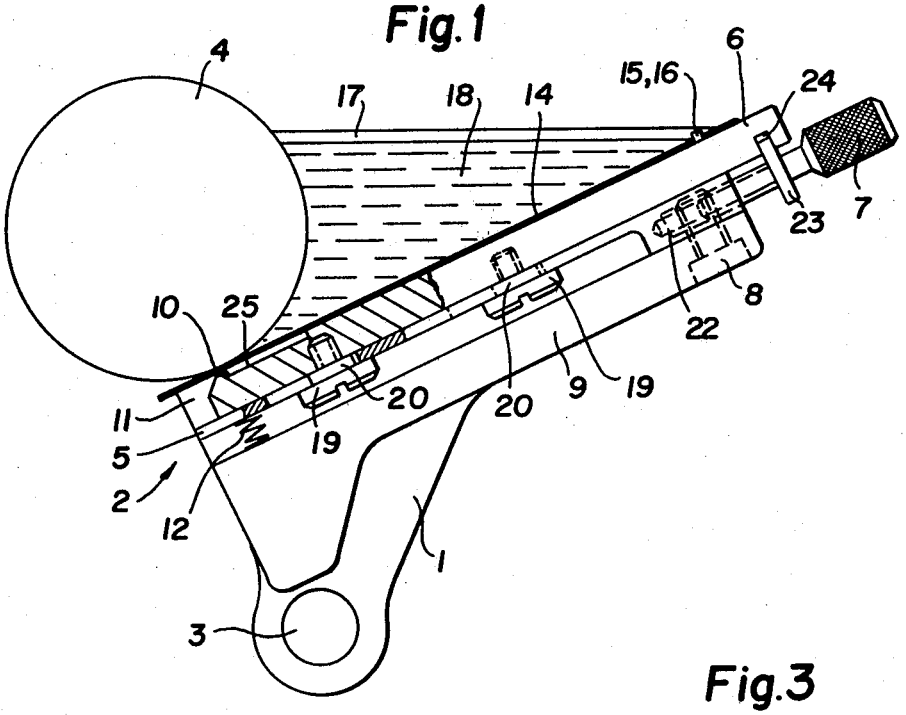
FIG. 1 is a partly sectional, partly elevational view of an ink duct incorporating the invention of the instant application with metering elements formed as flat members or tongues.

Referring now to the drawing and first, particularly, to FIG. 1 thereof, there is shown an ink duct 1 with an ink metering device 2 fastened thereto, the ink duct 1 being turnably mounted on a hinge 3 and swingable away from a duct roller 4. The ink metering device 2, which is formed primarily of an elastic or resilient support strip 5, metering elements 6 formed as flat members or tongues and adjusting screws 7, is fastened, in the upper region of the ink duct 1 to the latter by means of threaded connections 8 and lies on the base plate 9 of the ink duct 1. In vicinity of a metering edge 10, the elastic or resilient support strip 5 is, through support ledges 11, pressed by suitable springs 12 against the duct roller 4. The metering elements 6 formed as flat members or tongues are fitted between the support ledges 11. They thus lie on the elastic or resilient regions 13 of the support strip 5 disposed between the support ledges 11, which are of such elastic or resilient construction that respective adjacent support ledges 11 have virtually no effect upon one another. The entire ink metering device 2 is covered by an elastic foil 14. Holes 15 are punched into the foil 14 over the entire length along an edge thereof at a given mutual spacing. Furthermore, small pins 16 are provided at corresponding locations in the upper regions of the support ledges 11 wherefrom the elastic foil is suspended by means of the holes 15 thereof.

Figure 3:
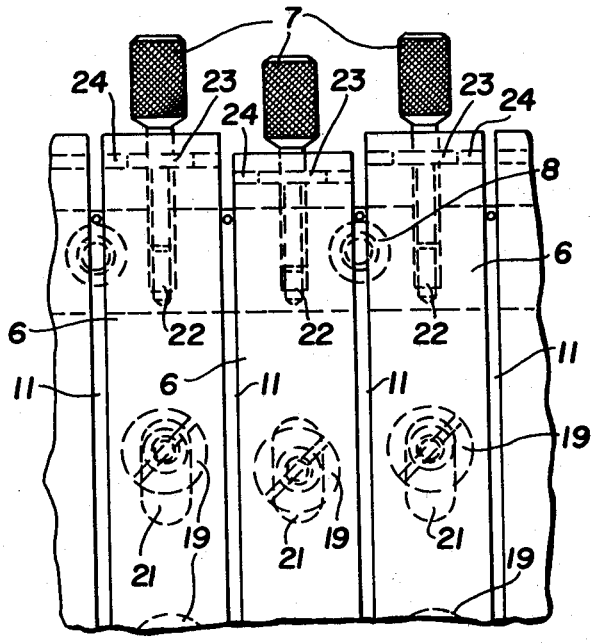
FIG. 3 is a fragmentary top plan view of FIG. 1 rotated counterclockwise through an angle of 45° and showing the disposition of the adjusting members.

Ink 18 is present in the wedge-shaped space between the foil 14, the ink duct roller 4 and opposing side walls 17 of the ink duct. By means of a respective pair of holding screws 19 provided at the underside of each of the metering elements 6 and having a respective suitably dimensioned shaft 20 extending below a screw head thereof and engaging in elongated grooves or slots 21 formed in the elastic support strip 5, the metering elements 6 are indeed, connected with the elastic support member 5, however, limited displacement of the metering elements 6 in longitudinal direction is possible. Set screws or adjusting screws 7, as shown in FIGS. 1 and 3, are provided for the displacement of the metering elements 6. Respective internal threads 22 formed in the upper region of the elastic or resilient support 5 at a regular spacing from one another serve to receive the aforementioned adjusting screws 7 therein. A ring 23 is mounted on the shaft of each of the adjusting screws 7 and engages in a respective recess 24 formed in the underside of each of the metering elements 6; when the respective adjusting screw 7 is suitably actuated, the respective ring 23 displaces the respective metering elements 6 in longitudinal direction thereof. Due to this longitudinal displacement, the gap between the ink duct roller 4 and the metering edge 10 is varied producing a zone-wide variation of the thickness of the ink layer. By means of a recess 25 formed on the upper side of each of the metering elements 6, as viewed in FIG. 1, the metering edge 10 may be shaped so that no dynamic pressure can be built up.

As a modification of the aforedescribed embodiment, it is also conceivable that the thread 22 in which the adjusting screws 7 are to be threadedly received not be formed in the elastic or resilient support strip 5, but rather in the upper region of the ink duct 1, as viewed in FIG. 1. This would be costly with respect to maintaining the compactness of the ink metering device 2, but would, however, simultaneously permit a more elastic or resilient formation of the elastic or resilient support strip 5.

Figure 2:
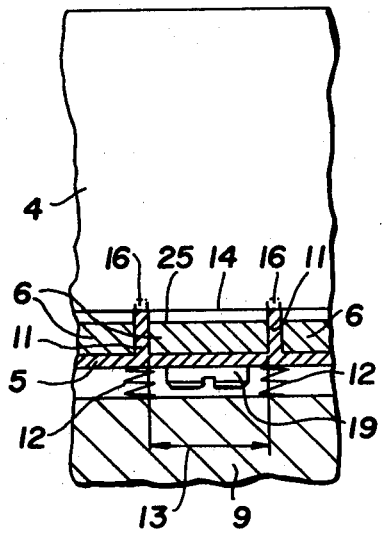
FIG. 2 is a fragmentary sectional view of FIG. 1.
Figure 4:
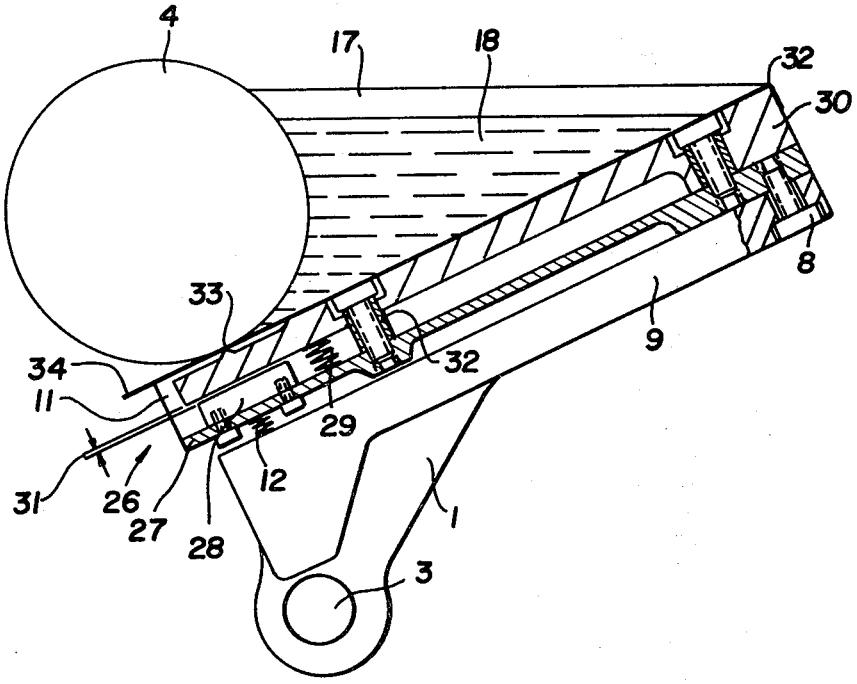
FIG. 4 is a view similar to that of FIG. 1 of another embodiment of the ink duct wherein the metering elements are magnetically actuated.
Figure 5:
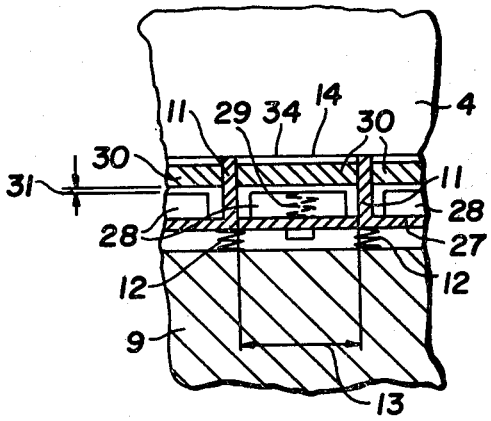
FIG. 5 is a view like that of FIG. 2 taken of the embodiment as shown in FIG. 4.

In the embodiment of the invention shown in FIGS. 4 and 5, as well, the ink metering device 26 also is placeable as a compact structural unit upon the ink duct 1 and, as in the embodiment according to FIGS. 1 to 3, is fastenable thereto. This occurs also, in this case, again in the upper region of the ink duct 1 while, in the lower region, contact with the ink duct roller 4 is effected by corresponding springs 12. In the vicinity of this springy contact, whereat the metering of the ink to be transported by the ink duct roller 4 is effected, electromagnets 28 are fastened to the support strips 27 in the elastic or resilient region 13 thereof. The electromagnets 28, the electrical connections of which are not illustrated, are associated, together with springs 29, with the metering elements 30 as adjusting means for continuously bringing the metering elements 30 pulsatingly into contact with the ink duct roller 4 and for forming a predetermined gap, the pulse frequency and pulse or stroke time being adjustable. This gap corresponds to the spacing 31 between the respective metering elements 30 and the electromagnet 28. Because of the springy contact of the elastic or resilient support strip 27 with the electromagnets 28 fastened thereto against the ink duct roller 4 and the simultaneous springy contact of the metering elements 30, this spacing 31 is always constant and reproducible even for varying operating conditions. The threaded connection between the metering elements 30 and the support strip 27 is so formed by means of intermediately connected spacer bushings 32 that the necessary freedom of movement in vertical direction is given to each metering element 30 in order to be able to effect the adjusting movements. The metering edge 33 is, in this case, again formed so that no dynamic pressure can be built up. In order to prevent soiling of the ink metering device 26, the latter is covered by an elastic foil 34 which is fastened to the metering element 30 in the upper region thereof.

There is claimed:

1. Ink metering device in an ink duct for offset or letterpress printing machines having an ink duct roller with metering and support regions disposed adjacent one another in axial direction of the ink duct roller the metering regions being formed of metering elements adjustable zonewise to varying ink gap spacings spring biasing means acting against the support regions, the support regions being continuously pressed against the ink duct roller under spring biasing force, said metering device comprising a continuous single resilient support strip extending over the entire length of the ink duct roller and supporting the metering elements, the support regions being support ledges formed on and projecting beyond said support strip, the metering elements being disposed between said support ledges, said biasing means acting on said support strip for bracing said support ledges against the ink duct roller.

2. Ink metering device according to claim 1 wherein the metering elements are formed as flat tongues, are disposed between said support ledges of said elastic support strip and are displaceable tangentially to the ink duct roller.

3. Ink metering device according to claim 1 wherein said adjusting means comprise respective springs and electromagnets disposed on said elastic support strip in an intermediate space between said metering elements and said elastic support strip a forward region of said metering elements formed with a respective metering edge being attracted by said electromagnets when said electromagnets are actuated, and said metering edge defining with the ink duct roller a gap therebetween for passage of ink therethrough.

* * * * *